United States Patent [19]

Gardineer

[11] Patent Number: 4,674,962

[45] Date of Patent: Jun. 23, 1987

[54] PERISTALTIC PUMP

[75] Inventor: Bayard G. Gardineer, Skillman, N.J.

[73] Assignee: Cobe Laboratories, Inc., Lakewood, Colo.

[21] Appl. No.: 788,245

[22] Filed: Oct. 17, 1985

[51] Int. Cl.[4] ..... F04B 43/12

[52] U.S. Cl. ..... 417/477

[58] Field of Search ..... 417/477, 476, 475

[56] References Cited

U.S. PATENT DOCUMENTS

| | | | |
|---|---|---|---|
| 3,180,272 | 4/1965 | Broadfoot | 417/477 X |
| 4,174,193 | 11/1979 | Sakakibara | 417/477 |
| 4,178,138 | 12/1979 | Iles | 417/360 |
| 4,518,327 | 5/1985 | Hackman | 417/477 |

FOREIGN PATENT DOCUMENTS

| | | | |
|---|---|---|---|
| 58-70079 | 4/1983 | Japan | 417/476 |
| 58-187593 | 11/1983 | Japan | 417/477 |

*Primary Examiner*—John J. Vrablik

[57] ABSTRACT

A peristaltic pump comprising a removable platen having a cylindrical passage about a platen axis, a flexible tube mounted on the inner surface and forming a loop around the platen axis, a rotor mounted on and extending from a housing for rotation about the platen axis, and a roller mounted on the rotor so as to squeeze the tube against the platen as the rotor rotates, the roller having an axis that is at an angle relative to that of the platen axis to cause the platen to be biased in the direction of the platen axis by the roller as the rotor rotates.

8 Claims, 4 Drawing Figures

PERISTALTIC PUMP

FIELD OF THE INVENTION

The invention relates to peristaltic pumps.

BACKGROUND OF THE INVENTION

In peristaltic pumps liquid is transported through a flexible tube by causing an occluded portion of the tube to travel along the tube, advancing the liquid in front of the occluded portion. In one type of peristaltic pump, rollers are employed at the periphery of a rotating head to squeeze a flexible tube positioned between the head and an outer stationary platen to thereby force liquid through the tube. A common use for such pumps is on medical devices in which the flexible tubing is changed between each patient, the tubing being threaded by hand between the rotating head and the platen. Isles U.S. Pat. No. 4,178,138 discloses a peristaltic pump that has a flexible tube that is secured to a removable platen which is locked in place adjacent to the rotating head via locking pins.

SUMMARY OF THE INVENTION

In general the invention features a peristaltic pump including a flexible tube secured to a removable platen and rollers on a rotating head that are angled so that during rotation they bias the platen toward the housing supporting the rotating head. In addition to securely holding the platen and tube in place, the angled rollers provide automatic loading of the platen onto the rotating head.

In some preferred embodiments the axes about which the rollers rotate are fixed, whereby rotation of the head in one direction causes the platen to be biased toward the housing, and rotation in the other direction causes the platen to be biased in the other direction, i.e., to be unloaded from the housing. In some other preferred embodiments rollers are mounted on shafts that are movable between two positions so that the platen can be biased toward the housing regardless of the direction of rotation of the rotating head.

Other features and advantages of the invention will be apparent from the following detailed description of the preferred embodiment of the invention and from the claims.

DESCRIPTION OF THE PREFERRED EMBODIMENT

The drawings are first briefly described.

Drawings

Structure

Figure 1:
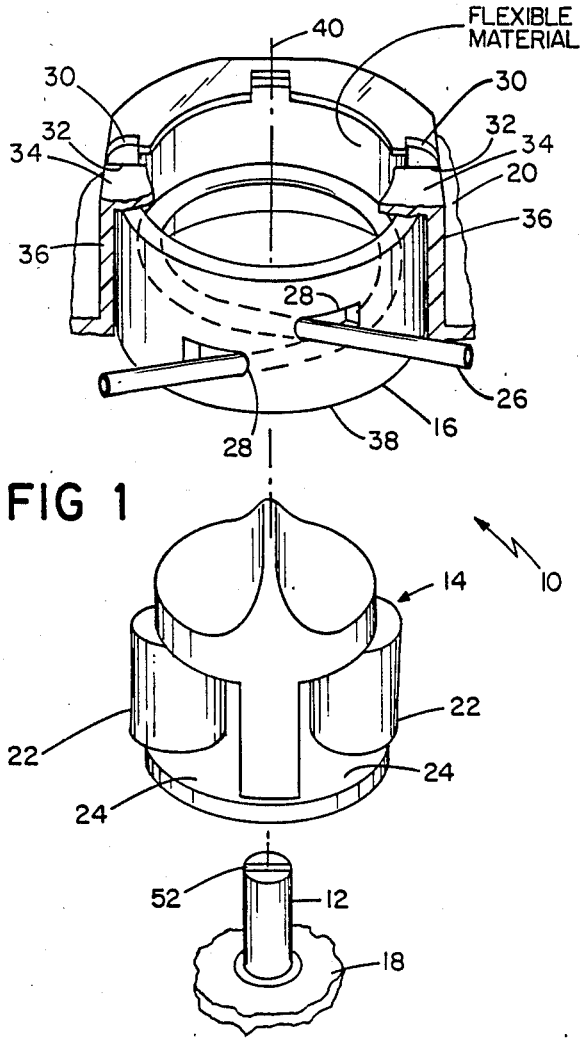
FIG. 1 is an exploded diagrammatic perspective view showing a peristaltic pump according to the invention.

Referring to FIG. 1, there is shown peristaltic pump 10 including motor shaft 12, rotor 14 and removable platen 16. Motor shaft 12 extends from the surface of medical device housing 18. Platen 16 is mounted on disposable plastic tray 20, which is shaped to mate with the surface of housing 18 and also contains another platen (not shown) for engaging another rotor on the surface of housing 18. Rotor 14 includes two rollers 22 mounted within recesses 24.

Flexible plastic tubing 26 is mounted on and forms a loop around the inner surface of platen 16. Tubing 26 is bonded to platen 16 by PVC cement, and the ends of tubing 26 extend through holes 28. Extending above the upper surface of platen 16 are flexible tabs 30, including lower surfaces 32 that bear downward against and are supported by upper surfaces 34 of wall 36 of tray 20 around platen 16. At the same time the upper surface of platen 16 bears upward against the lower surface of the overhanging lip of tray 20. Tabs 30 are snapped into position during assembly. Platen 16 is made of rigid PVC (80±5 Durometer, Shore D) and has an inner diameter of 2.087±0.006". Cylindrical wall 38 of platen 16 is 0.104±0.004" thick and has controlled flexibility, to provide controlled squeezing of tube 26. A 0.030" deflection results from the application of a 5.5±1.2 pound force extending radially outward, and a 0.060" deflection results from a 11.7±2.0 pound force. Holes 28 are spaced from each other by 0.320" along platen axis 40.

Figure 2:
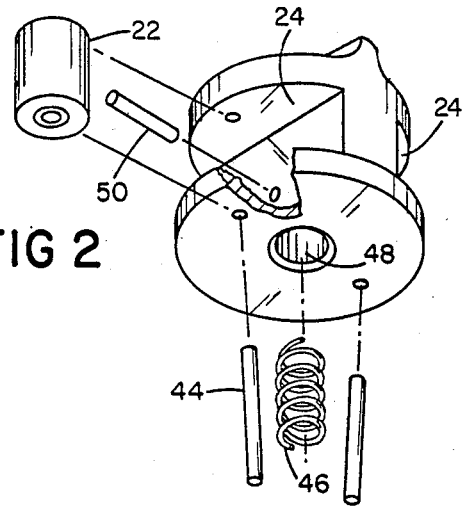
FIG. 2 is an exploded diagrammatic perspective view of a rotor of the FIG. 1 pump.
Figure 3:
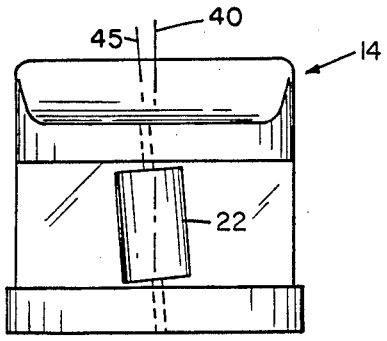
FIG. 3 is a diagrammatic vertical elevation of the FIG. 2 rotor.

Referring to FIG. 2, the assembly of rotor 14 is shown in detail. Roller 22 is made of Delrin plastic and has a 0.600±0.002" outer diameter and is mounted within recess 24 on shaft 44. Spring 46 is provided in shaft receiving hole 48 and locked in place by dowel 50, which fits within motor shaft groove 52 (bayonet-type connection) when secured on top of motor shaft 12. The centers of shafts 44 are spaced from each other by 1.400±0.002". Referring to FIG. 3 is seen that longitudinal axis 45 for shaft 44 is shifted by 4° in a plane that is perpendicular to a plane passing through longitudinal axis 40 and the center of roller 22. Tube 26 has a wall thickness and flexibility such that it will be completely occluded when rollers 22 push it outward against flexible platen 16.

Operation

In use, when tray 20 is moved toward housing 18 so that rotor 14 passes within platen 16, rollers 22 engage tubing 26, and the 4° angle of rollers 22 causes platen 16 to be biased downward when rotor 14 rotates in a clockwise direction. The lower surface of platen 16 bears directly against housing 18, and lower surfaces 32 of tabs 30 also bear against tray 20, pulling it against the housing. This force along axis 40 is due to the component of the roller surface motion that is in the direction of axis 40; the tube thus tends to ride along the roller. This assists in loading platen 16 and also tray 20 onto housing 18, and prevents the platen, and tray, from moving outward, as long as the rotor is moving in a clockwise direction. The entry of rotor 14 into the loop of tubing 26 in platen 16 deforms platen 16 to a slightly oblate configuration providing a radial force sufficient to assure occlusion of the tube at both rollers. Platen 16 is free to move slightly with respect to tray 20, and automatically centers itself with respect to rotor 14, so that accurate alignment between the tray and rotor is not required. Platen 16 is prevented from rotating by tabs 30. Because there are two platens and two rotors (the second of each not being shown), tray 20 is prevented from rotating.

To disengage tray 20 from housing 18, rotor 14 is rotated in a counterclockwise direction, biasing tubing 26, platen 16 and tray 20 away from housing 18.

OTHER EMBODIMENTS

Other embodiments of the invention are in the scope of the following claims.

Figure 4:
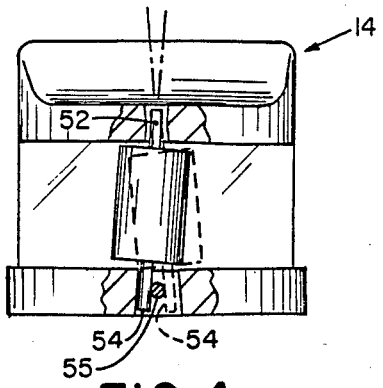
FIG. 4 is a diagrammatic vertical elevation of an alternative embodiment of the rotor.

For example, referring to FIG. 4, there is shown an alternative way to mount rollers 22 by making the shafts on which they rotate pivot about pins 52 through the tops of shafts 44. The lower portion 54 of shaft 44 is movable in a recess between first and second positions at which it makes 4° angles with the vertical. Set screw 55 can be used to lock shaft 44 in either the first or second position, causing the axial direction that the platen moves for a given rotational direction of the rotor to be reversed. Removing set screw 55 makes shaft 44 freely pivotal. In operation of the FIG. 4 device, without set screw 55 platen 16 is biased downward regardless of whether rotor 14 rotates clockwise or counterclockwise. Also, more than two rollers could be used.

What is claimed is:

1. A peristaltic pump comprising a removable platen having a cylindrical passage about a platen axis, said passage being defined by an inner surface, a flexible tube mounted on said inner surface and forming a loop around said platen axis, a housing, a rotor mounted on and extending from said housing for rotation about said platen axis, and a first roller mounted on said rotor so as to squeeze said tube against said platen as said rotor rotates, said roller being rotatable about an axis extending between two first points, both said first points being spaced radially the same distance from said platen axis, said two first points being circumferentially angularly spaced about said platen axis to produce a small angle between the roller axis and planes through the platen axis to cause said platen to be biased in the direction of said platen axis by said roller as said rotor rotates, thereby biasing said platen in the direction of said axis.

2. The pump of claim 1 further comprising a second roller mounted on said rotor so as to squeeze said tube against said platen as said rotor rotates, said second roller being rotatable about an axis extending between two second points, both said second points being spaced radially the same distance from said platen axis, said two second points being circumferentially angularly spaced about said platen axis to produce a small angle between the roller axis and planes through the platen axis to cause said platen to be biased in the direction of said platen axis by said roller as said rotor rotates.

3. The pump of claim 2 wherein said roller axes are fixed, whereby rotation in one direction causes said platen to be biased toward said housing, and rotation in the other direction causes said platen to be biased in the other direction.

4. The pump of claim 2 wherein each said roller is mounted on a shaft that is movable between first and second positions such that when said shaft is in said first position, clockwise rotation of said rotor causes biasing of said platen in one direction and counterclockwise rotation of said rotor causes biasing in the opposite direction, and, when said shaft is in said second position, counterclockwise rotation causes biasing of said platen in said one direction, and clockwise rotation causes biasing of said platen in said opposite direction, and further comprising means for locking said shaft in said first or said second position.

5. The pump of claim 2 wherein each said shaft is pivotally mounted on a shaft that is freely movable between first and second positions such that each said roller moves to a position to cause biasing toward said housing when said rotor is rotated both clockwise and counterclockwise.

6. The pump of claim 2 wherein said platen is made of flexible material that deforms to provide a radial force on said flexible tube sufficient to assure occlusion of said tube.

7. The pump of claim 6 wherein said platen is mounted for movement relative to said means for supporting in a direction transverse to said axis, whereby said platen is automatically centered with respect to said rotor, and accurate initial alignment of said platen with said rotor is not required.

8. The pump of claim 1 wherein said platen has a first bearing surface for bearing forces in the direction of said axis, and further comprising a tray for supporting said platen and mounted on said housing, said tray including second bearing surfaces bearing against said first bearing surfaces, whereby said biasing of said platen in said axial direction causes said tray to be pulled against said housing.

* * * * *